US007216673B2

(12) United States Patent
Gremour et al.

(10) Patent No.: US 7,216,673 B2
(45) Date of Patent: May 15, 2007

(54) NON-METALLIC EXPANSION TANK WITH INTERNAL DIAPHRAGM AND CLAMPING DEVICE FOR SAME

(75) Inventors: Nicholas C. Gremour, Jamestown, RI (US); Christopher A. Van Haaren, Warwick, RI (US)

(73) Assignee: Amtrol Inc., West Warwick, RI (US)

( * ) Notice: Subject to any disclaimer, the term of this patent is extended or adjusted under 35 U.S.C. 154(b) by 0 days.

(21) Appl. No.: 11/129,048

(22) Filed: May 12, 2005
(Under 37 CFR 1.47)

(65) Prior Publication Data

US 2006/0000839 A1 Jan. 5, 2006

Related U.S. Application Data

(60) Provisional application No. 60/570,733, filed on May 12, 2004.

(51) Int. Cl.
*F16L 55/04* (2006.01)

(52) U.S. Cl. ..... 138/30; 138/26; 220/723; 220/589

(58) Field of Classification Search ..... 138/30, 138/26; 220/723, 589, 590
See application file for complete search history.

(56) References Cited

U.S. PATENT DOCUMENTS

| | | | | |
|---|---|---|---|---|
| 3,557,827 A | | 1/1971 | Marsh | 137/590 |
| 3,815,773 A | | 6/1974 | Duvall et al. | 220/590 |
| 3,843,010 A | * | 10/1974 | Morse et al. | 220/590 |
| 3,931,834 A | | 1/1976 | Caillet | 138/30 |
| 4,214,611 A | | 7/1980 | Takacs et al. | 138/30 |
| 4,315,527 A | | 2/1982 | Donnenberg et al. | 138/30 |
| 4,595,037 A | | 6/1986 | LeBreton et al. | 138/30 |
| 4,785,956 A | * | 11/1988 | Kepler et al. | 220/590 |
| 5,287,987 A | * | 2/1994 | Gaiser | 220/589 |
| 5,368,073 A | | 11/1994 | Murphy | 138/30 |
| 5,386,925 A | | 2/1995 | Lane | 220/530 |

(Continued)

OTHER PUBLICATIONS

International Search Report dated Oct. 3, 2006.

*Primary Examiner*—Patrick F. Brinson
(74) *Attorney, Agent, or Firm*—Scott D. Wofsy; Edwards Angell Palmer & Dodge LLP

(57) ABSTRACT

A non-metallic, diaphragm-type tank assembly for use with a pressurized water system is disclosed. The tank assembly comprising a non-metallic outer body; a non-metallic inner shell assembly, including an upper portion and a lower portion, that is contained by the non-metallic outer body; and a diaphragm that is structured and arranged about the upper and lower portions of the inner shell assembly to separate said inner shell assembly into a water portion and a pressurized gas portion. Preferably, the diaphragm comprises a resilient, non-porous material and includes a bead portion comprising an annular ring that is convex on an inner side and concave on an outer side at its outer periphery. More preferably, the bead portion is removably secured to the overlapable end portion of the lower portion of the inner shell assembly by a clamping system that comprises an inner clamp hoop and an outer band. Specifically, the outer band can be mechanically crimped to compress and secure the second overlapable end portion and the bead portion of the diaphragm between the inner clamp hoop and the outer band to provide a watertight seal for the water portion.

26 Claims, 4 Drawing Sheets

U.S. PATENT DOCUMENTS 5,429,845 A * 7/1995 Newhouse et al. ..... 428/34.1
5,484,079 A 1/1996 Carter et al. ..... 220/589
5,499,739 A 3/1996 Greist, III et al. ..... 220/589
5,778,679 A 7/1998 Celorier, Jr. et al. ..... 62/47.1

* cited by examiner

NON-METALLIC EXPANSION TANK WITH INTERNAL DIAPHRAGM AND CLAMPING DEVICE FOR SAME

CROSS-REFERENCE TO RELATED APPLICATIONS

This application claims the benefit of priority from U.S. provisional application No. 60/570,733, which was filed on May 12, 2004, the disclosure of which is hereby incorporated by reference in its entirety.

FIELD OF INVENTION

The present invention relates to water systems, e.g., closed hot water heating systems, pressurized water systems, and the like, that include expansion tanks or well tanks and, more particularly, to water systems including non-metallic expansion tanks with an internal diaphragm that separate air cells from water cells.

DESCRIPTION OF THE RELATED ART

Water systems that provide and distribute well water domestically in rural parts of the country typically include a pump to draw water from the well; pipes or other conduits through which water travels; and a tank for storing water, e.g., a well tank. Well tanks, e.g., expansion tanks, are structured and arranged to store water until demanded and to accommodate internal pressures of the system. To this end, well tanks typically provide an air cushion for the supply water.

Generally, the water chamber in the interior of the tank assembly that stores water is in fluid communication with the pipes or conduits of the domestic water system. By design, the water chamber is structured and arranged to provide an operating pressure, e.g., about 20 to 40 pounds per square inch ("psi"), to the water system. To accomplish this, the compressible gas chamber contains a pressurized gas, e.g., nitrogen or, more preferably, air, that can force water through the water system and that, further, can prevent creation of negative, or back pressures in the water system during the cyclical demand for water and/or volume changes associated with the change in water temperature. If the pressure in the water chamber falls below the operating pressure, the pump is activated and water is added to the water chamber of the expansion tank until the water chamber again provides the operating pressure.

In any closed system containing air and water that undergoes natural or artificial temperature changes, the likelihood of problems stemming from interaction of air and water is great. Air is soluble in water and water readily absorbs air. Indeed, the amount of absorbed air in water is inversely proportional to the water temperature. Thus, as water is heated, e.g., in connection with a closed hot water heating system, the air in the water is liberated into the system and as heated water cools, the cooling heated water in direct contact with air, e.g., in the compression tank, absorbs some of the free air. By its very nature and through thermal circulation, air-charged water that is cyclically heated and cooled changes continually so that during the next heating cycle the re-absorbed air is again liberated into the system. This cyclical and reversible process is repeated as often as the heating, or firing, cycle is repeated and the boiler water is heated and cooled. This poses many problems to designers.

First, air released by heated water, typically, accumulates in the compression tank and other portions of the heating system. This accumulation results in reduced heating efficiency, often making continuous venting of radiators or convectors to bleed off the air necessary. Moreover, as water is heated, it can expand into the compression tank that is connected to the pipes and other conduits. Typically, in the compression tank, the expanding, heated water is in intimate communication with the released air and any other air in the tank. However, when the heated water reaches a desired temperature, the firing of the boiler ceases and the water begins to cool and contract. As the water cools, it re-adsorbs free air in the compression tank.

Second, when a tank includes an air cushion, the cooling water may absorb all or substantially all of the air cushion, leaving a static water system. Without an air cushion, or, more specifically, air pressure to force water through the system, a pressure pump may be needed constantly. Optionally, an air surge chamber can be provided that is not in direct contact with the water, thereby eliminating the need of the pressure pump operating every time a faucet was turned on. Pressure pumps and surge chambers increase the cost of a water system.

To address these shortcomings, conventional expansion and well tanks (collectively "tank assemblies") typically include impermeable diaphragms, or bladders, to separate the interior of the well tank into two chambers, or cells: a liquid, or water, chamber and a compressible, or pressurized, gas chamber. As water is pumped from a well into the tank assembly, the volume of the water in the water chamber increases, causing the diaphragm to contract the volume of the pressurized gas chamber. As the volume of the pressurized gas chamber decreases, the gas pressure in the pressurized gas chamber increases. As a result, when water for the tank is demanded by the water system, the gas in the pressurized gas chamber forces the water into the water system. Consequently, the volume of water in the water chamber decreases and the volume of the pressurized gas chamber increases. As a result, the pressure of the pressurized gas decreases.

Conventional diaphragms are constructed of a non-porous, elastic material, e.g., plastic or butyl rubber, and are sealed at the periphery or sidewall of the tank to provide an air- and watertight seal. Not only does use of a diaphragm avoid the above-described air-water problems, but, also, separation of water from the pressurized gas is desirable because water in the presence of oxygen produces oxidation that can damage metal or other portions of the system and, furthermore, can aerate the water, which can affect water quality.

An example of a conventional tank assembly is provided in commonly assigned U.S. Pat. No. 5,386,925 to Lane. The Lane patent provides an expansion tank comprising a deformable diaphragm that divides the tank into two sections. The diaphragm separates the gas in the one section of the tank from the water in the other section of the tank and the rest of the system. The gas section is pre-charged with gas under pressure so that the diaphragm is displaced to increase or decrease the volume of this section according to the variations of the volume of water in the other section.

The Lane expansion tank system includes two sections that are made of metal, which requires assembly with, i.e., welding to, a metal clamp ring that is disposed inside of the two tank portions. This assembly is relatively expensive and labor and time intensive to manufacture. Moreover, steel tanks can corrode from external environmental exposure, which can lead to deterioration of the tank assembly and the water system. Such deterioration can lead to catastrophic results, such as leaking tanks.

To provide some protection from corrosion, the inner surface of the liquid chamber portion of the metal expansion tank is covered by a water, or liquid impervious liner. This, however, requires fabricating the liner in a separate operation and then inserting the liner in the liquid chamber portion.

Therefore, it would be desirable to provide a non-metallic tank assembly that does not affect the quality or taste of the water or that does not deteriorate over time in a corrosive environment. It would also be desirable to provide a non-metallic tank assembly with an internal diaphragm interposed between the water chamber and the gas chamber to separate the water from pressurized gas. Furthermore, it would be desirable to provide a non-metallic, diaphragm-type tank assembly that can withstand the internal pressures normally associated with tank assemblies. Finally, it would be desirable to provide a lighter, non-metallic alternative to conventional metallic tank assemblies and to provide such a tank at lower cost.

SUMMARY OF THE INVENTION

It is an object of the present invention to provide a non-metallic, diaphragm-type tank assembly for use in combination with a well, potable water supply or non-potable water supply.

It is another object of the present invention to provide a lightweight, diaphragm-type tank assembly that is more economical to purchase and to maintain and that has a longer life than conventional metallic alternative tanks.

It is yet another object of the present invention to provide a diaphragm-type tank assembly that is more resistant in a corrosive environment than conventional metallic alternative tanks.

The present invention attains the foregoing and additional objects by providing a non-metallic, diaphragm-type tank assembly for use with a pressurized water system, the tank assembly comprising a non-metallic outer body; a non-metallic inner shell assembly, including an upper portion and a lower portion, that is contained by the non-metallic outer body; and a diaphragm that is structured and arranged about the upper and lower portions of the inner shell assembly to separate said inner shell assembly into a water portion and a pressurized gas portion.

Preferably, the non-metallic outer body is manufactured from wound fiber strands impregnated with a resin matrix, e.g., an epoxy resin or a thermoplastic resin, in a substantially cylindrical shape and, more preferably, the non-metallic outer body is formed as a single piece by at least one of the following manufacturing methods: injection molding, extrusion, blow molding, and roto-molding.

In a preferred embodiment, the non-metallic inner body is manufactured from a thermoplastic, e.g., by molding or extrusion, and the upper and lower portions of the non-metallic inner shell assembly are substantially dome shaped. Preferably, the upper portion of the non-metallic inner body has a first overlapable end portion and the lower portion of the non-metallic inner body has a second overlapable end portion, and the first overlapable end portion is secured to the lower portion to provide an airtight pressurized gas portion in the upper portion of the non-metallic inner shell assembly.

In one aspect of the present invention, the first overlapable end portion of the upper portion is adhesively secured to the lower portion. In another aspect of the present invention, the first overlapable end portion of the upper portion is secured to the lower portion by spin welding. In still another aspect of the present invention, the first overlapable end portion of the upper portion is secured to the lower portion by heat sealing. Optionally, the lower portion is provided with a ledge to which the first overlapable end portion can be fixedly or adhesively attached.

Preferably, the diaphragm comprises a resilient, non-porous material and/or an elastomeric material selected from a group comprising rubber, butyl rubber, thermoplastic, and elastomer plastic. More preferably, the diaphragm includes a bead portion comprising an annular ring that is convex on an inner side and concave on an outer side at its outer periphery. As a result, the bead portion of the diaphragm can be removably secured to the overlapable second end portion of the lower portion of the inner shell assembly to provide a watertight water portion in the lower portion.

In one aspect of the present invention, the bead portion is removably secured to the overlapable end portion of the lower portion of the inner shell assembly by a clamping system that comprises an inner clamp hoop and an outer band. Specifically, the outer band can be mechanically crimped to compress and secure the second overlapable end portion and the bead portion of the diaphragm between the inner clamp hoop and the outer band to provide a watertight water portion.

In a second embodiment, the present invention discloses a clamping assembly for securing an elastomeric diaphragm to the sidewall of a lower portion of an inner shell assembly to provide a watertight water portion and an airtight pressurized gas portion in the inner shell assembly of the water tank assembly. Preferably, the clamping assembly comprises an outer or external band that is mechanically crimped to provide an external hoop stress and an inner clamp hoop that provides a resisting hoop stress. More preferably, the external band is mechanically crimped to provide an external hoop stress that securely pinches the second overlapable end of the lower portion of the inner shell assembly and a beaded end of the diaphragm against the resisting hoop stress of the inner clamp hoop.

BRIEF DESCRIPTION OF THE DRAWING

For a fuller understanding of the nature and desired objects of the present invention, reference is made to the following detailed description taken in conjunction with the accompanying drawing figures wherein like reference characters and numerals denote corresponding parts throughout the several views and wherein.

DETAILED DESCRIPTION OF INVENTION AND ITS PREFERRED EMBODIMENT

Figure 1:
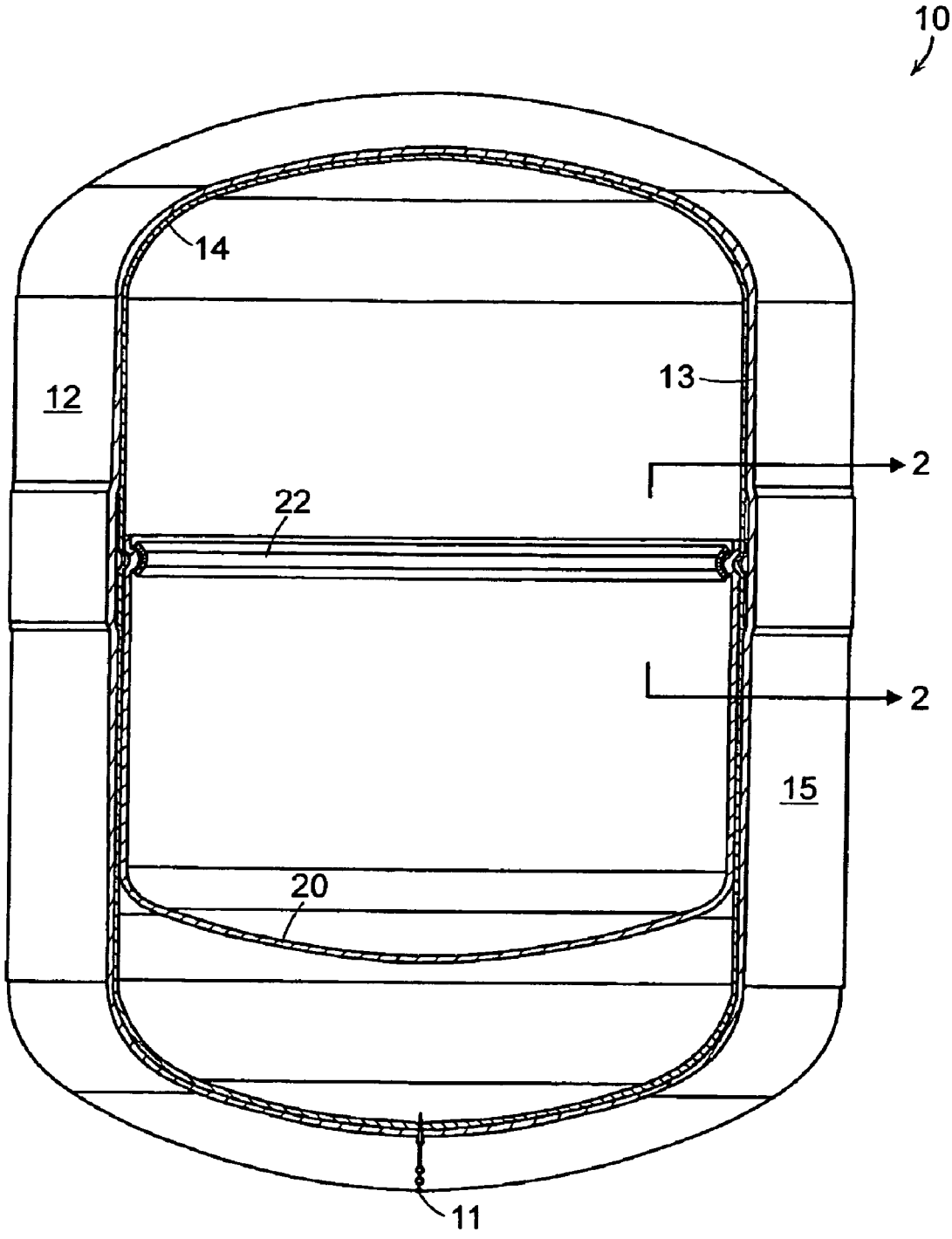
FIG. 1 is a diagram of an illustrative embodiment of a diaphragm-type tank assembly of the present invention.
Figure 2:
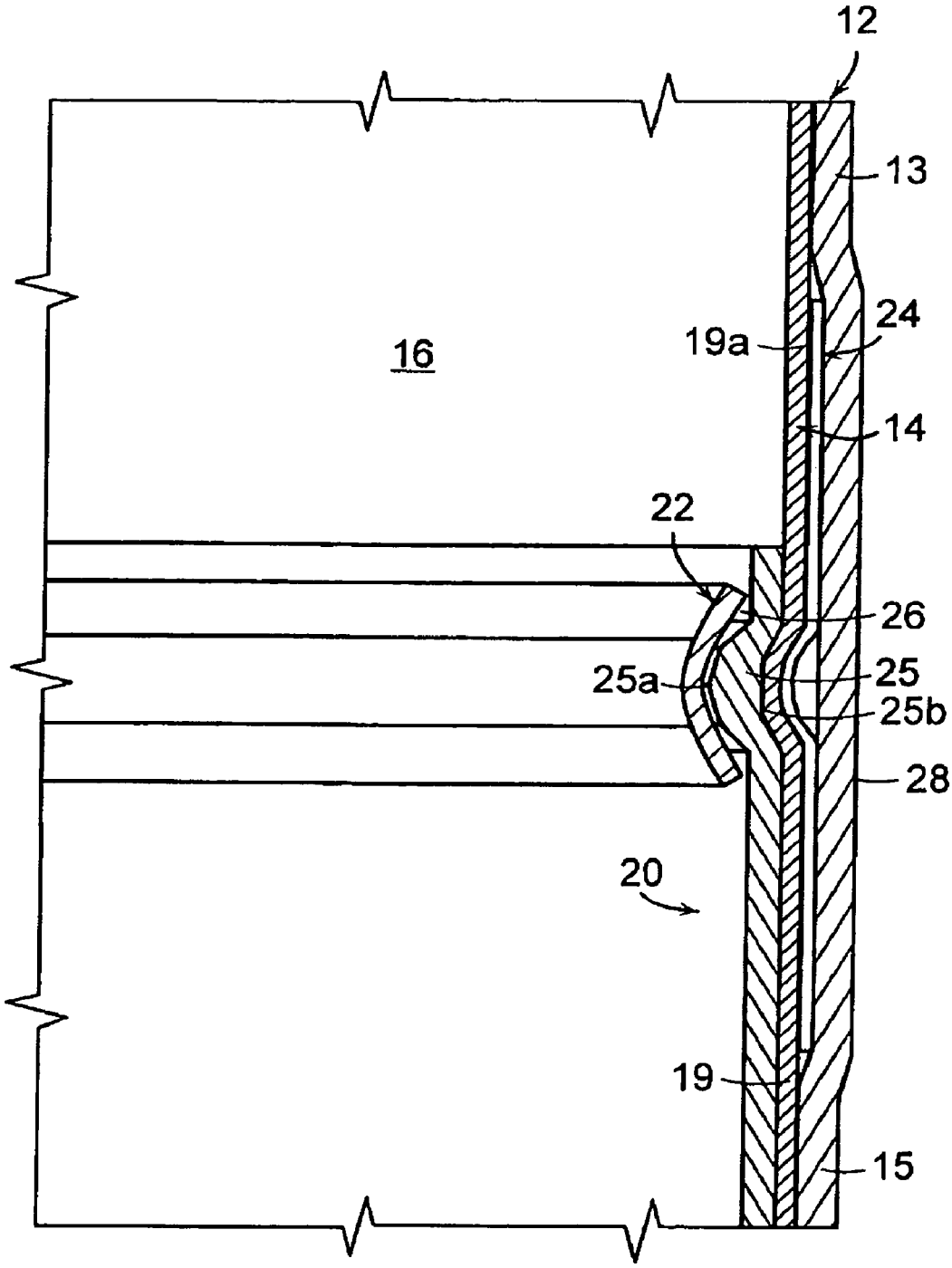
FIG. 2 is a diagram of an illustrative embodiment of a diaphragm clamping assembly in accordance with the present invention.

Referring now to the various figures of the drawings, wherein like reference characters refer to like parts, there is shown in FIGS. 1 and 2 an embodiment of a diaphragm-type tank assembly 10 in accordance with the present invention. The tank assembly 10 comprises an outer cylindrical housing or body 12 and an inner shell 14. The outer cylindrical body 12 is structured and arranged of a non-metallic material to provide structure and to protect the inner shell 14. The inner shell 14 is structured and arranged of a non-porous, non-metallic material, e.g., plastic, to provide a watertight water cell 18, or chamber, and an airtight pressurized gas cell 16, or chamber. A heavy gauge, non-porous, elastomeric diaphragm 20 is structured and arranged within the inner shell 14 to separate the water cell 18 and the pressurized gas cell 16.

Preferably, the outer cylindrical body 12 of the tank assembly 10 is made of fiber strands impregnated with a resin, e.g., an epoxy or thermoplastic resin. The fiber strands are preferably woven filaments, e.g., carbonaceous fibers, fiberglass, aramid fibers (Kevlar®), and the like. The cylindrical body 12 provides structural support to the tank assembly 10 and is capable of withstanding normal operating pressures associated with domestic water systems, e.g., 0 to about 100 psi. The cylindrical body 12 can be formed, e.g., by injection molding, extrusion, blow molding, rotomolding, and the like, to form a single piece.

The cylindrical body 12 of the tank assembly 10 includes openings and appurtenant connections that are normally associated with conventional tank assemblies. For example, the lower portion 15 of the cylindrical body 12 can include connections (not shown) or other means for providing fluid communication between the tank assembly 10 and the water distribution pipes or conduits. In addition to the connections, the cylindrical body 12 can include one or more drain-cock valves 11 for draining or bleeding water from the water cell 18. The connections in the cylindrical body 12 are structured and arranged to be in registration with similar connections (not shown) in the water cell 18 of the inner shell 14, which are described in greater detail below.

Similarly, the upper portion 13 of the cylindrical body 10 can include the necessary connections (not shown) or other means for providing fluid communication between the pressurized gas cell 16 and the ambient atmosphere. For example, these connections can include a pressure release valve (not shown), which extends through the cylindrical body 12 and the inner shell 14, to bleed off gas pressure in the pressurized gas cell 16 and/or to introduce more gas into the pressurized gas cell 16.

Preferably, the diaphragm 20 is made of a resilient, non-porous, elastomeric material, e.g., elastomer plastic, thermoplastic, rubber, butyl rubber, and the like, that can produce an air- and watertight seal between the two cells 16 and 18; that can withstand normal operating pressures associated with domestic water systems; that does not deionize or deteriorate in the presence of water and/or ions generally contained in water; and that is responsive to changes in volume of the water in the water cell 18 and to changes in pressure of the gas in the pressurized gas cell 16.

In a preferred embodiment, the diaphragm 20 includes a peripheral, or bead portion 25 at its outer perimeter. Preferably, the bead portion 25 is structured and arranged as an annular ring that is convex on its inner side 25*a* and concave on its outer side 25*b*. The diaphragm 20 is sealed at the sidewall of the inner shell 14 and, further, structured and arranged to provide airtight and watertight seals in the pressurized gas cell 16 and in the water cell 18, respectively.

Figure 3:
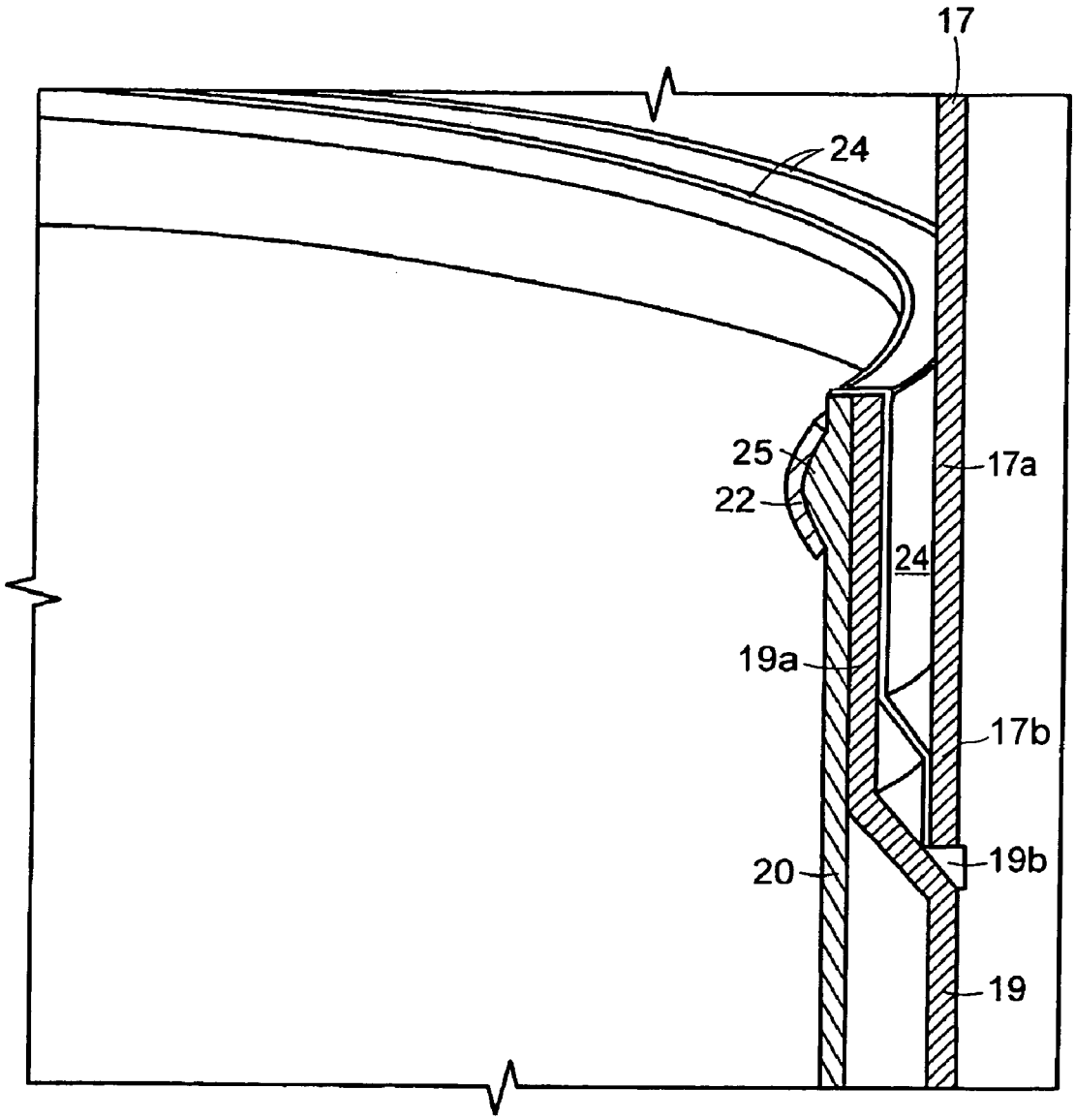
FIG. 3 is a diagram of an illustrative embodiment of the upper dome portion and diaphragm clamping assembly in accordance with the present invention.

Referring to FIG. 3, in a preferred embodiment, the inner shell 14 comprises an upper dome portion 17 and a lower dome portion 19 that have been molded or extruded individually. Preferably, the dome portions 17 and 19 include overlapable, free peripheral end portions 17*a* and 19*a*, respectively, that permit the peripheral end portion 17*a* of the upper dome portion 17 to mate with the lower dome portion 19. Similar to the cylindrical body 12, the inner shell 14 of the tank assembly 10 also includes connections and conduits (not shown) that are normally associated with conventional tank assemblies. The connections and conduits are further disposed in registration with similar connections and conduits in the cylindrical body 12.

For example, the lower dome portion 19 of the inner shell 14 can include connections (not shown) for providing fluid communication between the water cell 18 of the tank assembly 10 and the pipes or conduits of the water distribution system and/or drain-cock valves 11 for draining or bleeding water of other fluids from the water cell 18. Similarly, the upper dome portion 17 of the inner shell 14 can include a pressure release valve (not shown) that is in fluid communication with the ambient atmosphere through the cylindrical body 12 to bleed off gas pressure in the pressurized gas cell 16 and/or a connection for introducing more gas into the pressurized gas cell 16.

Figure 4:
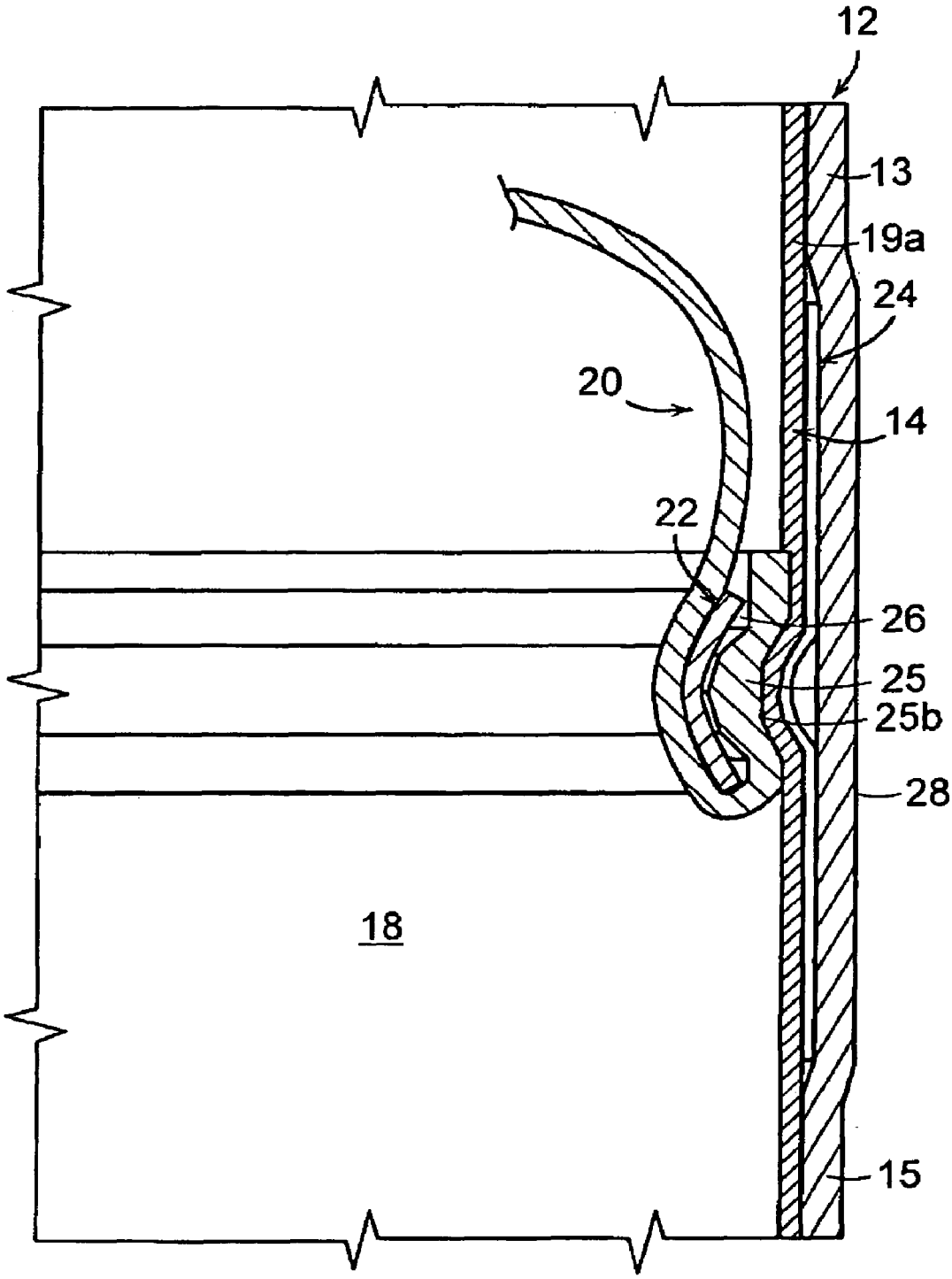
FIG. 4 is a diagram of an illustrative embodiment of a diaphragm clamping assembly in which water pressure has displaced the diaphragm into the pressurized gas chamber.

A preferred method of securing the diaphragm 20 at the sidewall of the end portion 19*a* of the lower dome portion 19 to provide a water chamber 18 will now be described. Referring to FIGS. 2 and 4, the bead 25 of the diaphragm 20 and the end portion 19*a* of the lower dome portion 19 of the inner shell 14 are shown sandwiched, i.e., clamped or pinched, between an inner clamp hoop 22 and an outer or external band 24. From the innermost diameter of the tank assembly 10, the clamping assembly includes the inner clamp hoop 22, the bead 25 of the diaphragm 20, the overlapped end portion 19*a* of the lower dome portion 19, and the outer band 24.

Preferably, the inner clamp hoop 22 comprises a grooved metal ring, e.g., a steel ring, that has been pre-fabricated to be substantially convex at its inner diameter and substantially concave at its outer diameter to provide a grooved portion 26.

In a preferred embodiment, the outer band 24 comprises a metal ring, e.g., a steel ring, that is mechanically crimped during assembly to provide a complementary groove that is substantially convex at its inner diameter and substantially concave at its outer diameter. In one aspect of the present invention, the inner, convex side 25*a* of the bead 25 of the diaphragm 20 is in intimate contact with the grooved portion 26 of the inner clamp hoop 22 and the outer, concave side 25*b* of the bead 25 of the diaphragm 20 is in intimate contact with the end portion 19*a* of the lower dome portion 19. The end portion 19*a* of the lower dome portion 19 is in intimate contact with the outer band 24.

The length of the overlapped portion 19*a* of the lower dome portion 19 should be of sufficient length to provide an acceptable factor of safety against slippage due to the operating pressures of the tank assembly 10 to prevent such slippage from affecting the integrity of air- and watertight seals.

Once the bead 25 of the diaphragm 20 and the overlapped end portion 19*a* of the lower dome portion 19 have been disposed in proximity of the groove 26 of the inner clamp hoop 22 and the outer band 24 has been disposed concentrically and coaxially about the inner clamp hoop 22 with the bead 25 of the diaphragm 20 and the overlapped end portion 19*a* of the lower dome portion 19 disposed between the inner clamp hoop 22 and the outer band 24, the entire assembly can be crimped or pinched together, e.g., using a crimping tool such as a mechanical crimper. Preferably, the crimping tool, e.g., mechanical crimper, can travel around the periphery of the assembled device, exerting a force around the periphery of the outer band 24 to provide a groove in the outer band 24 that is in registration with the groove 26 of the inner clamp hoop 22.

The effect of the crimping or pinching is that the inner clamp hoop 22 produces and exerts a radial, or hoop stress against the closely clamped, i.e., pinched, overlapped end portion 19*a* of the lower dome portion 19 of the inner shell 14, the bead 25 of the diaphragm 20, and the outer band 24. The grooved portion of the outer band 24 is structured and arranged to provide and exert a resisting hoop stress to retain the pinched or crimped overlapped end portion 19*a* of the lower dome portion 19 of the inner shell 14 and the bead 25 of the diaphragm 20. The diaphragm assembly that is produced does not expose any metal in the water cell 18 of the inner liner 14.

Once the clamping assembly has been crimped, portions of the outer band 24 that do not provide hoop stress resistance can be removed (not shown). Alternatively, as shown in FIG. 3, an upper portion of the outer band 24 can be mechanically formed to pass over the upper portion of the bead 25 of the diaphragm 20 and the overlapped end portion 19*a* of the lower dome portion 19.

A preferred method of securing the upper dome portion 17 to the assembled lower dome portion 19 and aforementioned diaphragm clamping assembly to provide a pressurized gas cell 16 and to complete the inner shell 14 of the tank assembly 10 will now be described. Referring to FIG. 3, there are shown the previously described diaphragm clamping assembly and the overlapped end portion 17*a* of the upper dome portion 17. Preferably, the overlapped end portion 17*a* of the upper dome portion 17 can be secured to a shoulder portion 19*b* that is pre-formed in the lower dome portion 19 for that purpose. More preferably, only the tip 17*b* of the upper dome portion 17 is secured to the shoulder portion 19*b* of the lower dome portion 19. Means of securing the tip 17*b* to the shoulder portion 19*b* include, without limitation, adhesively, by spin welding, by heat-sealing, and the like. However, the invention is not to be construed as being so limited.

With this arrangement, gas in the pressurized gas cell 16 and water in the water cell 18 can be confined between the diaphragm 20 and, respectively, the upper dome portion 17 of the inner shell 14 and the lower dome portion 19 of the inner shell 14 to provide airtight and watertight environments. Moreover, in one aspect of the present invention, the diaphragm 20, as it displaces as a function of water volume and/or gas pressure, is able to displace within the inner circumference of the inner hoop 22. Further, as the water volume increases, the diaphragm 20 displaces into the pressurized gas cell 16 in such a manner so as to cover the inner hoop 22 and prevent water from contacting the inner clamp hoop 22. The outer shell 12 can be then be placed about the assembled inner shell 14 in a manner that is well known to those of ordinary skill in the art to complete the tank assembly 10.

Although a preferred embodiment of the invention has been described using specific terms, such description is for illustrative purposes only, and it is to be understood that changes and variations may be made without departing from the spirit or scope of the following claims.

What is claimed is:

1. A non-metallic, diaphragm-type tank assembly for use with a pressurized water system, the tank assembly comprising:

a non-metallic outer body;

a non-metallic inner shell assembly, including an upper portion and a lower portion, that is contained by the non-metallic outer body;

a diaphragm that is structured and arranged on an inner side of the inner shell assembly near a point of connection between the upper and lower portions of the inner shell assembly to separate the inner side of said inner shell assembly into a water portion and a pressurized gas portion;

an inner clamp hoop that is structured and arranged to press its outer periphery against the diaphragm; and an outer band that is structured and arranged coaxially with the inner clamp hoop, wherein the inner clamp hoop and outer band can be crimped or pinched to compress and secure the inner shell assembly and a bead portion of the diaphragm between the inner clamp hoop and outer band to provide a watertight chamber between the diaphragm and the lower portion of the inner shell assembly.

2. The tank assembly as recited in claim 1, wherein the non-metallic outer body is substantially cylindrical in shape.

3. The tank assembly as recited in claim 1, wherein the non-metallic outer body is formed monolithically by at least one of the following manufacturing methods: injection molding, extrusion, blow molding, and roto-molding.

4. The tank assembly as recited in claim 1, wherein the non-metallic outer body is manufactured from wound fiber strands impregnated with a resin matrix.

5. The tank assembly as recited in claim 4, wherein the wound fiber strands consist of woven filaments selected from a group consisting of carbonaceous fibers, fiberglass, and aramid fibers.

6. The tank assembly as recited in claim 4, wherein the resin matrix is selected from a group consisting of an epoxy resin and a thermoplastic resin.

7. The tank assembly as recited in claim 1, wherein the non-metallic inner body is manufactured from a thermoplastic.

8. The tank assembly as recited in claim 1, wherein the upper and lower portions of the non-metallic inner shell assembly are substantially dome shaped.

9. A non-metallic, diaphragm-type tank assembly for use with a pressurized water system, the tank assembly comprising:

a non-metallic outer body;

a non-metallic inner shell assembly, including an upper portion and a lower portion, that is contained by the non-metallic outer body; and a diaphragm that is structured and arranged on an inner side of the inner shell assembly near a point of connection between the upper and lower portions of the inner shell assembly to separate the inner side of said inner shell assembly into a water portion and a pressurized gas portion, wherein the upper portion of the non-metallic inner body has a first overlapable end portion and the lower portion of the non-metallic inner body has a second overlapable end portion, and wherein the first overlapable end portion is secured to the lower portion to provide an airtight pressurized gas portion in the upper portion of the non-metallic inner shell assembly.

10. The tank assembly as recited in claim 9, wherein the first overlapable end portion of the upper portion is structured and arranged over and attached to the second overlapable end portion.

11. The tank assembly as recited in claim 10, wherein the first overlapable end portion of the upper portion is adhesively secured to the lower portion.

12. The tank assembly as recited in claim 10, wherein the first overlapable end portion of the upper portion is secured to the lower portion by spin welding.

13. The tank assembly as recited in claim 10, wherein the first overlapable end portion of the upper portion is secured to the lower portion by heat sealing.

14. The tank assembly as recited in claim 10, wherein the lower portion is provided with a ledge to which the first overlapable end portion can be fixedly or adhesively attached.

15. The tank assembly as recited in claim 1, wherein each of the upper and lower portions of the non-metallic inner shell assembly is molded or extruded.

16. The tank assembly as recited in claim 1, wherein the diaphragm is formed from a non-porous material.

17. The tank assembly as recited in claim 1, wherein the non-porous material is an elastomeric material selected from a group comprising rubber, butyl rubber, thermoplastic, and elastomer plastic.

18. A non-metallic, diaphragm-type tank assembly for use with a pressurized water system, the tank assembly comprising:

a non-metallic outer body:

a non-metallic inner shell assembly, including an upper portion and a lower portion, that is contained by the non-metallic outer body; and a diaphragm that is structured and arranged on an inner side of the inner shell assembly near a point of connection between the upper and lower portions of the inner shell assembly to separate the inner side of said inner shell assembly into a water portion and a pressurized gas portion, wherein, at an outer perimeter, the diaphragm includes a bead portion comprising an annular ring that is convex on an inner side and concave on an outer side.

19. The tank assembly as recited in claim 18, wherein the bead portion of the diaphragm is removably secured to the overlapable end portion of the lower portion of the inner shell assembly to provide a watertight water portion in the lower portion.

20. The tank assembly as recited in claim 19, wherein the bead portion is removably secured to the overlapable end portion by a clamping system that comprises an inner clamp hoop and an outer band, wherein the clamping system and bead portion are crimped or pinched to compress and secure the second overlapable end portion and the bead portion of the diaphragm between the inner hoop and the outer band to provide the watertight water portion.

21. The tank assembly as recited in claim 20, wherein the inner clamp hoop is a grooved ring having a convex inner portion and a concave outer portion, the concave outer portion being structured and arranged to accommodate the convex inner portion of the bead portion of the diaphragm.

22. The tank assembly as recited in claim 20, wherein the outer band is structured and arranged to provide a complementary groove that includes a convex inner portion and a concave outer portion when crimped or pinched so that the convex inner portion of the complementary groove and the second overlapable end portion are disposed in the concave outer portion of the bead portion of the diaphragm and secured between the concave outer portion of the bead portion of the diaphragm and the convex inner portion of the outer band.

23. A clamping assembly for securing a resilient, non-porous diaphragm to an inner side of an inner shell assembly of a tank assembly to provide a water portion and a pressurized gas portion in the inner shell assembly of the tank assembly, the inner shell assembly comprising an upper portion with a first overlapable end and a lower portion with a second overlapable end, the clamping assembly comprising:

an inner clamp hoop that is structured and arranged to provide a concave groove on its outer periphery; and an outer band that is structured and arranged coaxially with the inner clamp hoop, wherein the outer band can be crimped or pinched to compress and secure the second overlapable end portion of the lower portion of the inner shell assembly and a bead portion of the diaphragm between the concave groove of the inner clamp hoop and the outer band to provide a watertight chamber between the diaphragm and the lower portion of the inner shell assembly.

24. The clamping assembly as recited in claim 23, wherein the inner clamp hoop is a grooved ring having a convex inner portion and a concave outer portion, the concave outer portion being structured and arranged to accommodate a convex inner portion of the bead portion of the diaphragm.

25. The clamping assembly as recited in claim 23, wherein the outer band is structured and arranged to provide a complementary groove that includes a convex inner portion and a concave outer portion when crimped or pinched so that the convex inner portion of the complementary groove and the second overlapable end portion are disposed in the concave outer portion of the bead portion of the diaphragm and secured between the concave outer portion of the bead portion of the diaphragm and the convex inner portion of the outer band.

26. A non-metallic, diaphragm-type tank assembly for use with a pressurized water system, the tank assembly comprising:

a non-metallic outer body;

a non-metallic inner shell assembly, including an upper portion and a lower portion, that is contained by the non-metallic outer body; and a diaphragm that is structured and arranged on an inner side of the inner shell assembly near a point of connection between the upper and lower portions of the inner shell assembly to separate the inner side of said inner shell assembly into a water portion and a pressurized gas portion, wherein the non-metallic outer body is formed monolithically by at least one of injection molding, extrusion, blow molding, and roto-molding.

* * * * *